US009702076B2

(12) United States Patent
Bocchino et al.

(10) Patent No.: US 9,702,076 B2
(45) Date of Patent: Jul. 11, 2017

(54) WASHING MACHINE WITH A STORAGE TANK FOR REUSING WATER AND METHOD FOR CARRYING OUT A WATER REUSE STEP

(71) Applicant: Whirlpool Corporation, Benton Harbor, MI (US)

(72) Inventors: Gianluca Bocchino, Rome (IT); Marco Cagliani, Varese (IT); Luca Caruso, Lonate Pozzolo (IT); Claudio Civanelli, Travedona Monate (IT); Daniele Martinello, Besozzo (IT)

(73) Assignee: Whirlpool Corporation, Benton Harbor, MI (US)

( * ) Notice: Subject to any disclaimer, the term of this patent is extended or adjusted under 35 U.S.C. 154(b) by 113 days.

(21) Appl. No.: 14/219,346

(22) Filed: Mar. 19, 2014

(65) Prior Publication Data

US 2014/0283312 A1 Sep. 25, 2014

(30) Foreign Application Priority Data

Mar. 19, 2013 (EP) ..... 13159882

(51) Int. Cl.
*D06F 39/00* (2006.01)
*D06F 39/08* (2006.01)

(52) U.S. Cl.
CPC ..... *D06F 39/006* (2013.01); *D06F 39/083* (2013.01)

(58) Field of Classification Search
None
See application file for complete search history.

(56) References Cited

U.S. PATENT DOCUMENTS 6,336,541 B1 * 1/2002 Belfiore ..... D06F 37/302 192/116.5
2012/0137447 A1 * 6/2012 Aykroyd ..... D06F 35/005 8/137

FOREIGN PATENT DOCUMENTS

| | | | |
|---|---|---|---|
| DE | 1006821 | B | 4/1957 |
| DE | 4409303 | A1 * | 11/1985 |
| DE | 4409303 | A1 | 11/1995 |
| DE | 19530042 | A1 | 2/1997 |
| DE | 202013100539 | U1 | 3/2013 |
| EP | 2312042 | A1 | 4/2011 |
| WO | 2009141218 | A1 | 11/2009 |

OTHER PUBLICATIONS

DE4409303A1, English machine translation.*
European Search Report for Corresponding EP 13159882.3, Sep. 2, 2013.

* cited by examiner

*Primary Examiner* — Michael Barr
*Assistant Examiner* — Jason Riggleman

(57) ABSTRACT

A washing machine comprises a tub in which a drum is rotatably mounted, and a storage tank having a flow connection to the tub via a feeding line provided with a pump and a three-port valve adapted to drive the flow to the drain or to the storage tank, rinsing fluid being stored in the storage tank for subsequent reuse. The washing machine further comprises a return pipe connecting the storage tank to the tub by means of a two-port valve, on such return line an auxiliary pump being placed and being used either for emptying the storage tank or for carrying out a spray washing.

16 Claims, 4 Drawing Sheets

WASHING MACHINE WITH A STORAGE TANK FOR REUSING WATER AND METHOD FOR CARRYING OUT A WATER REUSE STEP

CROSS-REFERENCE TO RELATED APPLICATIONS

This application claims the benefit of European Patent Application No. 13159882.3, filed Mar. 19, 2013, which is incorporated herein by reference in its entirety.

BACKGROUND

The present invention relates to a washing machine comprising a tub in which a drum is rotatably mounted, and a storage tank having a flow connection to the tub via a feeding line provided with a pump and a three-port valve adapted to drive the flow to a drain or to said storage tank. According to such features, a rinsing fluid can be stored in the storage tank and used in a subsequent washing cycle in order to reduce the overall amount of water used for washing laundry.

SUMMARY

A washing machine of the above kind is disclosed by WO2009/141218. In the recent years the water consumption of washing machines has been becoming one of the critical parameters for washer evaluation. Starting in 2013, there will be applied a new standard in the Energy Label (EU), affecting the amount of water allowed. This means that, besides the respect of the new norms, the water consumption is becoming more and more important.

One of the ways to reduce the water consumption is to use the same water more than once. For example, it is possible to use the water from a rinse phase of a previous cycle for the main wash of the following cycle. To do this, it is necessary to find a place, inside the washing machine, where to store the water from the rinse, with a bunch of components (pumps, valves. pipes etc.) to allow water flows.

The above known solution disclosed by WO2009/141218 allows storage of rinsing water in a storage tank, but it requires the use of two three-port valves, one upstream the storage tank for diverting liquid to the tank or to a discharge line, and a second one for diverting the liquid from the discharge line to the drain or back to the tub by means of a circulation line. The use of two three-port valves makes the control of the washing more complex and also such three-port valves have to react rapidly in order to avoid cross flows. This increases the overall cost of the washing machine. Another disadvantage of the above known solution is the need to place the storage tank in a position so that it can be emptied by gravity.

It is an object of the present invention to provide a washing machine of the above type which does not present the above disadvantages and which has a low cost. According to the invention, such object is reached thanks to the features listed in the appended claims.

One of the main features according to the invention is to provide the washing machine with a return line connecting the storage tank to the tub by means of a two-port valve; on such return line, downstream the two-port valve, it is placed an auxiliary pump for assuring a complete emptying of the storage tank.

According to a preferred embodiment of the invention, the auxiliary pump is also used to recirculate washing liquid from a lower position in the tub to an upper position.

BRIEF DESCRIPTION OF THE DRAWINGS

Further advantages and features according to the present invention will become clear from the following detailed description, provided as non limiting example, with reference to the annexed drawings in which.

DESCRIPTION OF EMBODIMENTS OF THE INVENTION

Figure 1:
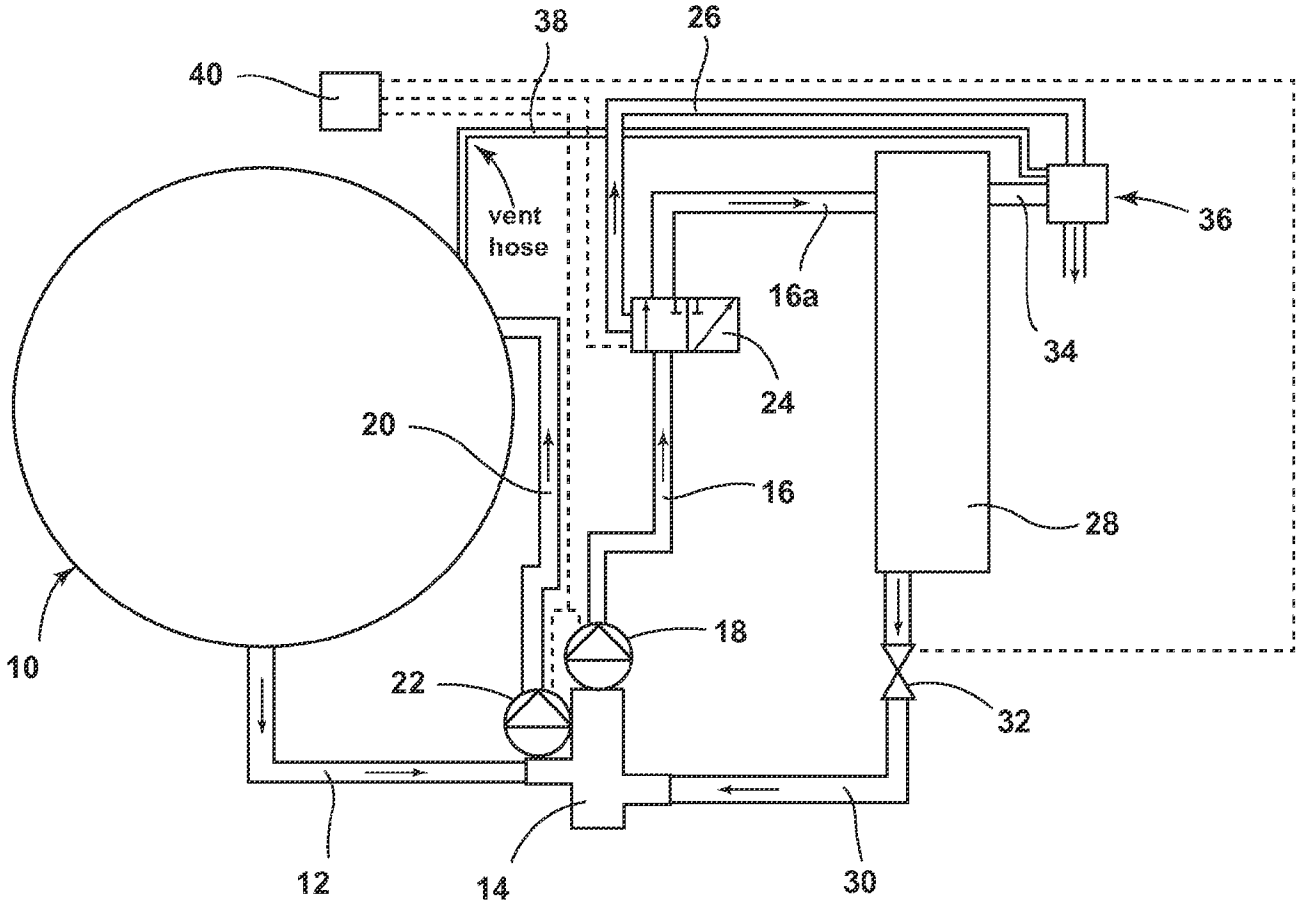
FIG. 1 is a hydraulic scheme of a washing machine according to the invention in which the directions of water in different lines of the circuit are shown by arrows.

With reference to the drawings, a washing machine according to the invention comprises a washing tub 10 having a discharge conduit 12 connected to a pump body 14 provided with a filter (not shown). To the pump body 14 two lines are connected, i.e. a feeding line 16 provided with a drain pump 18 and a recirculation line 20 with an auxiliary pump 22. Both drain pump 18 and auxiliary pump 22 are fitted on the same pump body 14. On the feeding line 16, downstream the drain pump 18, a three-port valve 24 is placed in order to alternatively drive the liquid to a drain line 26 or to a second portion 16*a* of the feeding line 16 connected to an upper position of a storage tank 28. The three-port valve 24 can be a two-position diverter valve with any kind of actuator, for instance a wax motor, an electric motor or a linear motor. In a lower position of the storage tank 18 a return line 30 connects the storage tank 28 to the pump body 14 with the interposition of a two-port valve 32 with an actuator of the same type or different type than the diverter valve 24. The storage tank 28 is also provided in its upper zone with an overflow line 34 which connect the tank to an automatic valve 36 from which liquid is sent to drain and to which a vent hose 38 from the tub 10 is connected. All the electrical components of the hydraulic circuit, i.e. the two pumps 18 and 22, the two-port valve 32 and the diverter valve 24 are driven in a predetermined sequence by a control unit 40.

The water storage tank 28 is the container capable to keep the water stored from the previous washing cycle. The sequence of operation starting from the main wash (in this phase the storage tank 28 is empty) is as follows.

At the end of the main wash phase, the drain pump 18 starts to empty the wash unit or tub 10. The position of the diverter valve 24 is such that the water is driven directly to the automatic valve 36 and then outside the washer to a sink or to a drain pipe. Once the wash unit 10 is empty and the spin extraction done, the wash unit 10 is filled again with fresh water, and one (or more) rinse is performed.

Figure 3:
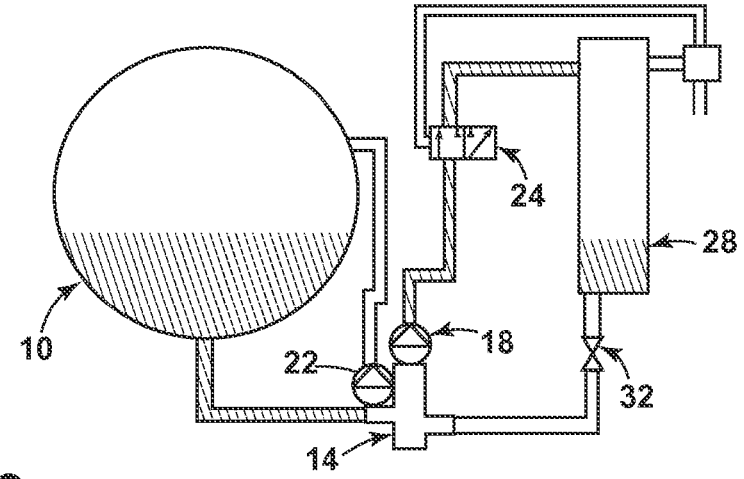
FIG. 3 shows the initial configuration of the hydraulic circuit during water tank filling phase.
Figure 4:
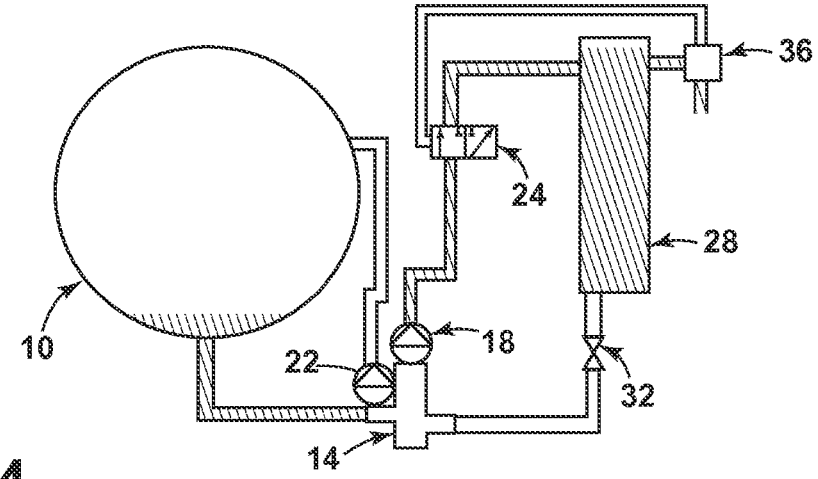
FIG. 4 shows the final configuration during water tank filing, when the exceeding water foes directly to an overflow line.

At the end of the rinse, the diverter valve 24 is switched to drive the water to the water storage tank 28. The drain pump 18 starts filling the storage tank 28 (FIG. 3) with the water to be reused. In case of too much water, the excess goes to the drain through the short overflow connection 34 between the storage tank 28 and the automatic valve 36 (FIG. 4). At the end the storage tank 28 is full. The diverter valve 24 is then switched back to the original position.

The rest of the washing cycle is performed normally, leaving the water tank full at the end. During the next washing cycle, the two-port valve 32 is opened and the auxiliary pump 22 is activated in order to empty the storage tank. This brings the stored water to the wash unit 10, until the water storage tank 28 is empty. If the auxiliary pump 22 is not activated when the two-port valve is in its open configuration (FIG. 2), then only a portion of the stored water flows to the tub 10 and this is an advantage when not all the stored water has to be used. The remaining water in the storage tank 28 may then be evacuated by using the drain pump 18 when the tub is emptied too.

Figure 7:
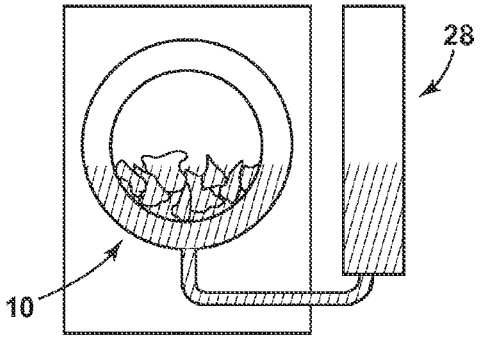
FIGS. 7-8 are schematic views showing the soaking process of laundry, at different times.

The portion of the stored water that can fed to the washing unit (tub 10) is linked to the relative height between storage tank 12 and washing tub 10 and to the absorption capability of the laundry. Once the two-port valve 32 is opened the water starts to enter into the washing unit till the water inside washing unit will reach the same level of water inside storage tank 12 (FIG. 7). Due to soaking capability of the laundry the water level inside the washing tub 10 will decrease and new water, coming from the storage tank 12, will enter the washing tub 10. This soaking process will end when the laundry will be not able to absorb more water.

Figure 8:
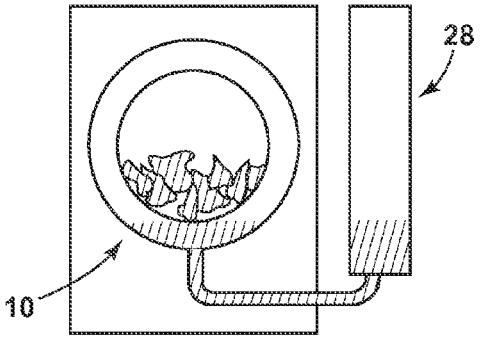

This will happen if the laundry is saturated or if the water level in the tub 10 is under the drum (FIG. 8).

Another way to reduce the water coming from tank is to close the two-port valve 32 after a fixed time or as soon as a fixed water level is reached inside the washing unit.

Figure 9:
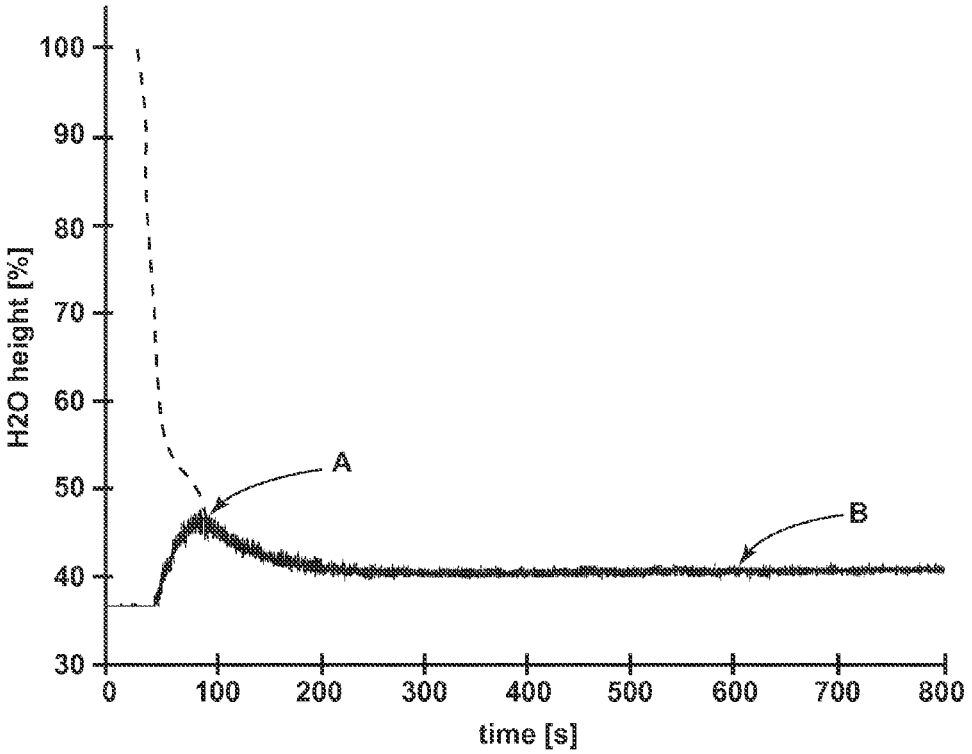
FIG. 9 is a diagram showing the level in both the storage tank and in the washing tub during the soaking process of FIGS. 7-8.

FIG. 9 shows how the levels in the storage tank 28 (dotted line) and in the tub 10 (solid line) change after the two-port valve 32 is opened. Point A in the diagram relates to when water inside the storage tank 28 and inside the washing tub (10) reach the same level, while point B shows the final water level reached in the tub 10 at the end of the laundry soaking phase.

When the two-port valve 32 is closed, the auxiliary pump 22 is switched off and some fresh water is taken from the tap through the detergent dispenser (not shown), to deliver the detergent to the wash unit 10. Only part of the water required is taken from the tap, because most of it has been taken from the storage tank 28, allowing a substantial water saving. At this point the situation is again as in step one above.

Figure 6:
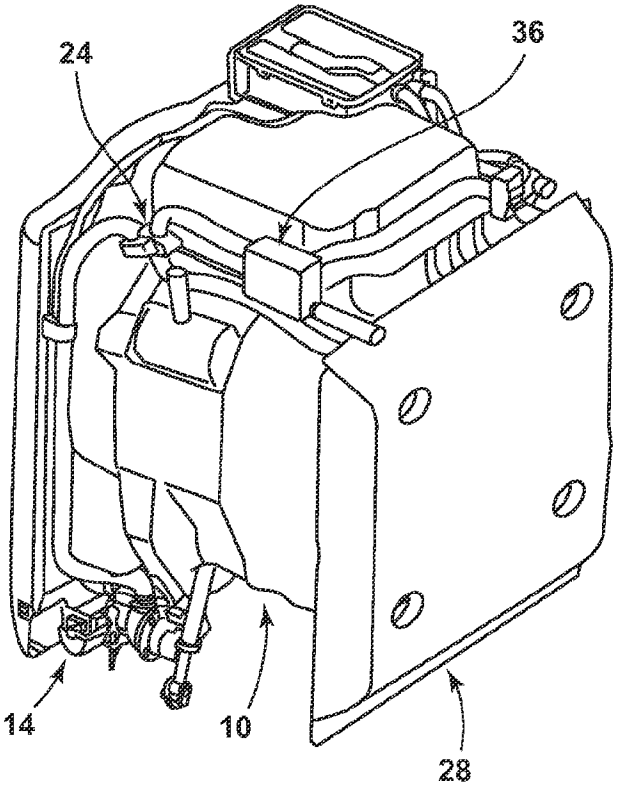
FIG. 6 is a perspective view of the hydraulic circuit of FIG. 5 mounted in a front load washing machine.
Figure 5:
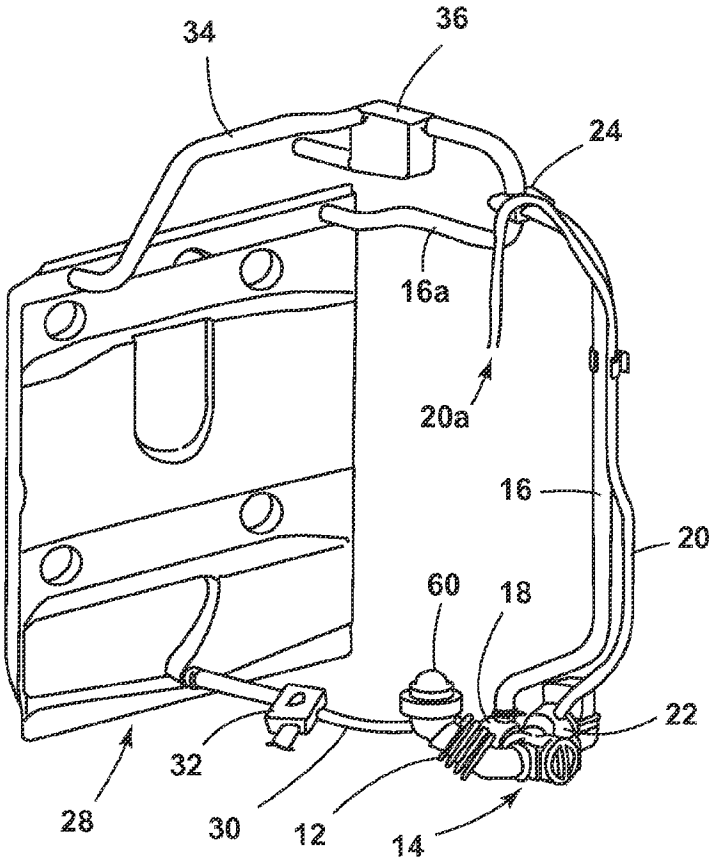
FIG. 5 is a perspective view of the actual hydraulic circuit according to the invention as tested by the applicant.

FIGS. 5 and 6 show the configuration of the hydraulic circuit tested by the applicant. Such solution allows the use of a storage plastic tank 28 of about 13.5 liter placed on the back side of the tub 10. The storage tank 28 is advantageously made by means of blow-molding or rotational-molding.

It is clear from FIGS. 5 and 6 how the hydraulic system according to the present invention allows a very easy installation by exploiting free spaces around the tub. The position of the storage tank 28 (with a bottom lower than the bottom portion of the tub 10) which faces a zone where the motor and transmission (not shown) are placed (either with traditional belt-pulley transmission or direct drive) allows also a further reduction of possible noises thereof. In FIG. 5 it is shown a nozzle 20*a* of the recirculation line 20 by which spray washing can be carried out during washing cycle. In FIG. 5 it is also shown a usual automatic ball valve 60 placed between the discharge line 12 and the tub 10 for avoiding any waste of detergent to the drain.

The hydraulic configuration layout according to the invention allows solving several problems that could limit the operability of the water reuse system.

Figure 2:
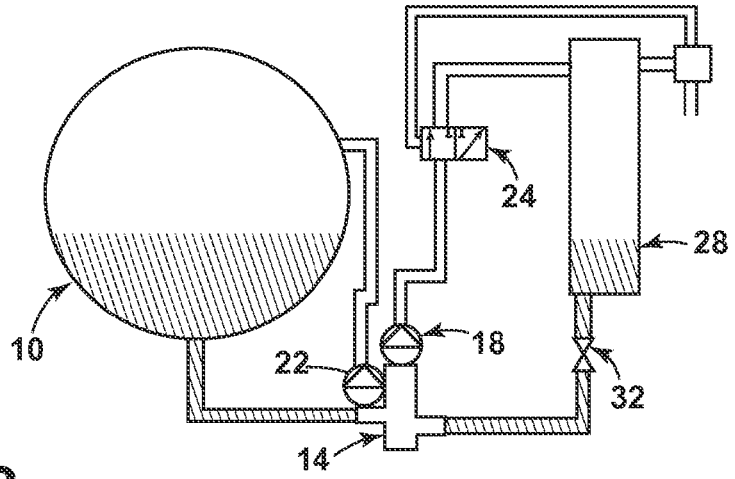
FIG. 2 is similar to FIG. 1 and shows the draining phase of water stored in the storage tank without the use of the auxiliary pump.

The use of an auxiliary pump 22 as a recirculation pump allows considering not relevant the water storage tank position referred to the wash unit 10. Indeed if the water storage tank 28 has a lower level which is not higher than the upper level of water in the wash unit 10 an incomplete draining of the storage tank 28 can occur. FIG. 2 highlights the situation due the communicating vessels phenomena.

With the recirculation pump 22 in combination with the two-port valve 32 this issue can be solved. To drain completely the tank, at first the two-port valve 32 is switched on. Then, by the recirculation pump 22 the water is conducted directly on the load. The load absorption avoids the water refill in the circuit. Without the auxiliary pump 22 the only way to drain the storage tank 28 is by gravity and this constrains to have the tank 28 in an upper position.

The correct filling of the storage tank 28 and the management of a possible overflow is another technical problem solved by the present invention, particularly when valves without an instantaneous response are used (for instance valves driven by a wax motor with a PTC thermistor) in view of cost or space problems. In these situations a good solution can be the use of an overflow system. During the filling of the storage tank 28, the excess water can flow freely through the overflow line 34 and the automatic valve 36 to the sink. This situation is shown in FIG. 4. The automatic valve 36 is essentially a four-port valve which allows separating the overflow line 34 to the standard drain line 26 and avoiding dangerous water mixing.

The use of the recirculation pump 22, in combination with the two-port valve 32, allows recirculating the water stored in the storage tank 28 during the main wash. By opening the two-port valve 32 and switching on the recirculation pump 22 the water of the storage tank 28 is injected in the wash unit 10 directly on the load. The reuse of stored water in combination with the direct injection of the water on the load allows a reduction of annual water consumption and a potential increasing in cleaning performances.

The position of both pumps 18 and 22, i.e. in a lower position than the water storage tank 28 tank, gives the possibility to completely drain the storage tank 28 and allows recirculating the water in the wash unit 10.

In case a fast actuator is used for the two-port valve 32, by using the recirculation pump 22 and the actuator itself (that closes at the right moment), it is also possible to "dose" the water to be reused. This can be carried out in function of the actual load and could be better controlled by using the traditional level sensor of the washer and/or an additional sensor in the storage tank 28.

The main advantages of the hydraulic configuration according to the invention can be summarized as follows:

- the water storage tank position is not constrained to any emptying issues;
- the position of the auxiliary pump 22 allows completely draining the water storage tank
- the overflow line 34 allows filling the storage tank 28 without any problem of valve closing/opening time the position of the auxiliary pump 22 allows recirculating the water stored in the storage tank 28 in the wash unit 10.

Even if a hydraulic system with a single body pump has been disclosed, it is possible to use two separate pumps instead of a single double pump body.

What is claimed is:

1. A washing machine comprising:

a tub;

a drum rotatably mounted within the tub;

a storage tank for storing liquid in the storage tank for subsequent reuse and having a flow connection to the tub via a feeding line;

a first pump, defining a drain pump;

a first valve selectively coupling the drain pump to a drain or to the storage tank;

a return line connecting the storage tank to the tub;

a second valve selectively coupling the return line to the tub; and a second pump, defining an auxiliary pump provided on the return line and configured to pump liquid from the storage tank to the tub and wherein the auxiliary pump is downstream of the second valve.

2. The washing machine according to claim 1, further comprising a recirculation line fluidly coupled between the auxiliary pump and the tub.

3. The washing machine according to claim 2, wherein the recirculation line enters the tub at a level higher than a level at which the feeding line is connected to the tub.

4. The washing machine according to claim 2 wherein the recirculation line is adapted to be used for recirculation washing through use of the auxiliary pump.

5. The washing machine according to claim 1, wherein it comprises a control process unit adapted to drive the drain pump, the auxiliary pump, the first valve and the second valve according to a predetermined sequence.

6. The washing machine according to claim 1, wherein a portion of the feeding line is downstream of the first valve and the portion of the feeding line is connected to an upper position of the storage tank.

7. The washing machine according to claim 1, further comprising a discharge line downstream of the first valve, an overflow line downstream of the storage tank, and an automatic control valve fluidly coupled to and selectively controlling a flow through the discharge line and the overflow line.

8. The washing machine according to claim 7, further comprising a vent hose directly coupling the automatic control valve to the tub.

9. The washing machine according to claim 1, wherein at least a portion of the storage tank is positioned at a level lower than that of a lower part of the tub.

10. The washing machine according to claim 1, wherein the first valve or the second valve is driven by a wax motor with a PTC thermistor.

11. A method for washing laundry in a washing machine comprising a tub in which a drum is rotatably mounted, and a storage tank having a flow connection to the tub via a feeding line provided with a first pump, in the form of a drain pump, and a first valve adapted to drive a flow to a drain or to the storage tank, rinsing liquid being stored in the storage tank for subsequent reuse, the method comprising:

pumping liquid through the feeding line into the storage tank utilizing the drain pump, and keeping stored liquid in the storage tank up to its reuse;

feeding liquid from the storage tank, through a return line and a second valve in an open configuration, to the tub utilizing a second pump, in the form of an auxiliary pump, where the auxiliary pump is downstream of the second valve; and closing the second valve when a liquid level in the storage tank has reached a predetermined level.

12. The method according to claim 11, further comprising recirculating liquid in the tub by the auxiliary pump.

13. The method according to claim 12 wherein the feeding liquid from the storage tank to the tub is adjusted by controlling an opening time of the second valve and knowing a flow rate of the auxiliary pump.

14. The method according to claim 11 wherein the second valve is a two-port valve.

15. A method for washing laundry in a washing machine comprising a tub in which a drum is rotatably mounted, and a storage tank having a flow connection to the tub via a feeding line provided with a drain pump and a three-port valve adapted to drive a flow to a drain or to the storage tank, rinsing liquid being stored in the storage tank for subsequent reuse, the method comprising:

pumping liquid through the feeding line into the storage tank and keeping stored liquid in the storage tank up to its reuse;

feeding liquid from the storage tank, through a return line and a two-port valve in an open configuration, to the tub utilizing an auxiliary pump; and closing the two-port valve when a liquid level in the storage tank has reached a predetermined level.

16. A washing machine comprising:

a tub;

a drum rotatably mounted within the tub;

a storage tank for storing liquid in the storage tank for subsequent reuse and having a flow connection to the tub via a feeding line;

a drain pump;

a first valve selectively coupling the drain pump to a drain or to the storage tank;

a return line connecting the storage tank to the tub;

a second valve selectively coupling the return line to the tub and where the second valve is a two-port valve; and an auxiliary pump provided on the return line and configured to pump liquid from the storage tank to the tub.

* * * * *